US006039679A

United States Patent [19]

Yu

[11] Patent Number: 6,039,679

[45] Date of Patent: Mar. 21, 2000

[54] ELECTRONIC DUMBBELL

[76] Inventor: Simon S. C. Yu, 3806 Whittle Ave., Oakland, Calif. 94602

[21] Appl. No.: 09/369,257

[22] Filed: Aug. 9, 1999

[51] Int. Cl.[7] ..... A63B 21/22

[52] U.S. Cl. ..... 482/110; 482/1; 601/15; 601/18; 601/73

[58] Field of Search ..... 482/1, 5, 6, 7, 482/93, 109, 110; 601/15, 18, 21, 46, 70, 72, 73

[56] References Cited

U.S. PATENT DOCUMENTS

| | | | |
|---|---|---|---|
| 5,807,215 | 9/1998 | Abe et al. | 482/110 |
| 5,868,653 | 2/1999 | Klasen | 482/110 |

OTHER PUBLICATIONS

*Popular Mechanics* "Motor Driven Barbell Vibrates the Muscles" Feb. 1962, p. 136.

*Primary Examiner*—John Mulcahy
*Attorney, Agent, or Firm*—Linval B. Castle

[57] ABSTRACT

An exercising dumbbell comprising a tubular body with attached "U" shaped handle for use with two hands. The body contains a D.C. motor which is geared to a stationary central shaft and which may rotate around the shaft to generate strong vibrations. Batteries are contained within the handle and motor speed is varied from zero to maximum by pressure activated switches under each hand. Function switches on the body reverse motor direction, permit one-hand, both-hand or hands-free operation, provide music through an included speaker, and generate an exhilarating train of pulses.

13 Claims, 3 Drawing Sheets

ELECTRONIC DUMBBELL

This invention related to exercise equipment and in particular to a battery operated unit that is violently vibrated by an internal, eccentric, variable speed D.C. motor controlled by hand operated pressure sensitive switches.

BRIEF SUMMARY OF THE INVENTION

The modern trend toward physical fitness and personal weight reduction has resulted in a vast number of various types of exercise machines, most of them large and awkward rowing machines, stationary bicycles or weight lifting devices. Rather than purchase these machines and share space for them in their home, many people desiring exercise have joined fitness clubs which have these machines and are also equipped with less aggressive types of equipment such as the dumbbells, low tension hand grip and pull strings. The exercises are supervised and are very beneficial but, unfortunately, many of these people find these fitness clubs inconvenient or too costly and quit them, intending somehow to continue their exercise at home.

This invention is for a lightweight electronic dumbbell that is small enough to fit in a bureau drawer yet will give a good physical workout. It is battery operated and therefore cordless and safe from electrical dangers. It has cylindrical shaped housing coupled to a "U" shaped handle which contains batteries and pressure activated switches for controlling a D.C. motor that is eccentrically mounted within the housing. The rotating motor generates strong vibrations which aid in circulation and muscle development depending upon how and where the dumbbell is held.

The dumbbell contains some extra features in addition to the basic generator of powerful vibrations. The dumbbell has external electrodes and internal circuitry for generating very narrow electric pulses for muscle toning. For those people who may get bored with mere exercise, the dumbbell has an included sound system that can produce music or instructions through a small speaker mounted in the body. There are several small light emitting diodes that can flash to divert the attention and, for those who endorse the use of magnetic fields for improving blood circulation, one end of the circular housing is concave and is surrounded with an embedded permanent magnet.

The dumbbell enables its user to exercise at home out of sight and without interference by the casual bystander. The dumbbell is relatively lightweight and is easy to use by either hand, by both hands or, by switch a function switch on the body, in a hands-free mode without need of the pressure activated switches on the handles. Two pair of these pressure sensitive switches are located on the handles: one pair on the inner side of each handle stimulate the hand and arm muscles as the user attempts to pull apart the dumbbell, the other pair on the exterior of each handle exercise the arm and shoulder as the user attempts to press the dumbbell together. In the hands-free mode, the pressure activated switches are bypassed and the dumbbell may be used as a vibrator for the neck and back to stimulate legs and feet.

Users of conventional dumbbells rely upon the weight of the dumbbells for muscle training. In this invention, the dumbbell weight is relatively light and not a factor because stimulation and toning of the muscles of the body relies upon the vibration produced by a variable centrifugal force of an eccentrically mounted D.C. motor within the housing of the dumbbell.

According to Newton's second law of mechanics the numerical value of force of an object in rectilinear motion equals mass of the object times its acceleration, F=MA. If the object is in rotational motion, it can be shown that this converts to $F=MV^2/r$, where V is the rotational velocity and r is the radius of rotation. In the dumbbell of the invention, the D.C. motor is mounted off center so that it spins around a central axis. The motor has a fixed mass and is at a fixed radius from the central axis. Therefore the centrifugal force generated by the spinning motor is directly proportional to the square of the rotational velocity. And rotational velocity of a D.C. motor may be varied by varying the D.C. voltage so that a voltage increase resulting in doubling the rotational velocity in quadrupling the force. the pressure activated switches on the handle of the dumbbell vary the D.C. voltage of the motor; the tighter one presses a pressure activated switch, the higher the voltage supplied to the motor. It is suggested that, with proper alignment of the dumbbell and by carefully adjusting the motor speed, the dumbbell vibrations could be made to coincide with a natural resonant frequency of body fat to help effect weight loss.

DESCRIPTION OF THE DRAWINGS

In the drawings which illustrate the preferred embodiment of the invention.

DETAILED DESCRIPTION OF THE PREFERRED EMBODIMENT

Figure 1:
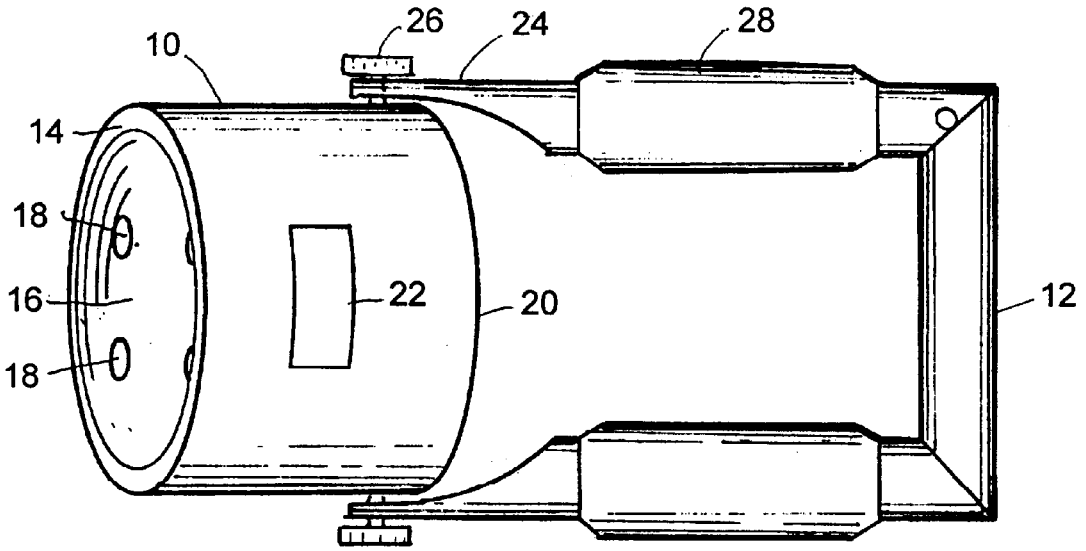
FIG. 1 is a perspective view illustrating the dumbbell of the invention.

The electronic dumbbell is illustrated in FIG. 1 and comprises a short, tubular plastic main body 10 supported on a "U" shaped handle 12. One end of the body 10 has a flat rim 14 bordering a concave surface 16 that has several small lamps 18 that flash when energized. The opposite end 20 of the body 10 is a flat surface with the handles of several function switches emanating therefrom (not shown). a metallic label 22, electrically insulated from the body 10, is attached to the arcuate surface of the tubular body and serves as an electrode for a pulse stimulation circuit.

Figure 2:
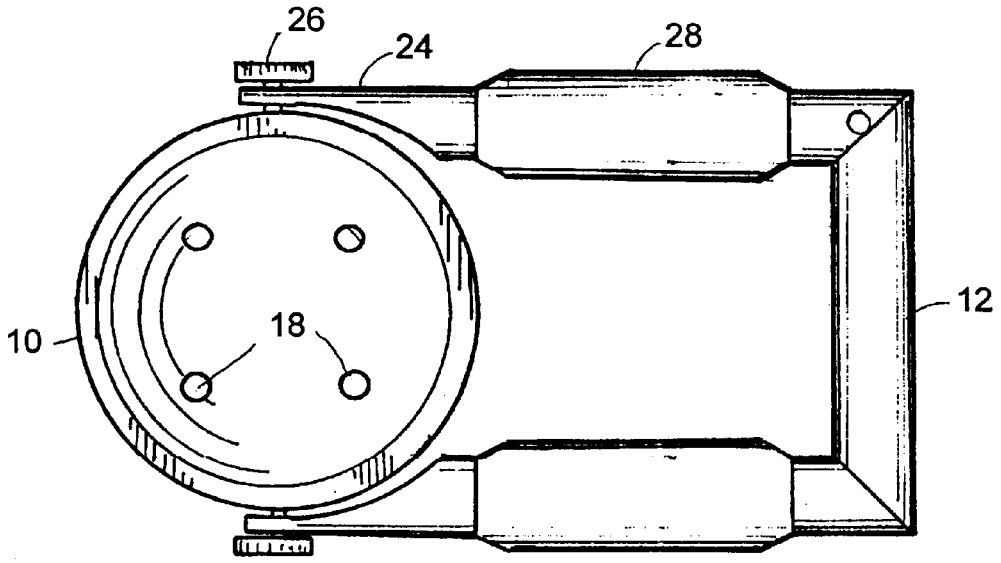
FIG. 2 illustrated the dumbbell pivoted at a right angle on its "U" shaped handle.

The "U" shaped handle 12 is attached to the body 10 by two screws that lie on the diameter of the tubular body near its end 20 and emanate from the body to pass through a reinforced thin section 24 of the handle 12 where they are secured to the handle by large wheel-like nuts 26. If desired, these nuts 26 may be loosened and the body rotated so that the central axis through the tubular body is at a right angle to the plane of the handle 12, as shown in FIG. 2.

The "U" shaped handle 12 is also tubular and contains batteries for supplying power to the D.C. motor that provides the intense vibrations of the dumbbell. Around the exterior of each handle 12 at the locations where the hands will grip the handle are pressure activated switches 28 that control the rotational speed of the D.C. motor. As will subsequently be described in detail, no pressure of these switches results in no voltage to the motor and voltage increases as the pressure is increased. There is, however, a function switch that, when closed, will supply full voltage to the motor without applying pressure to a pressure activated switch.

Figure 3:
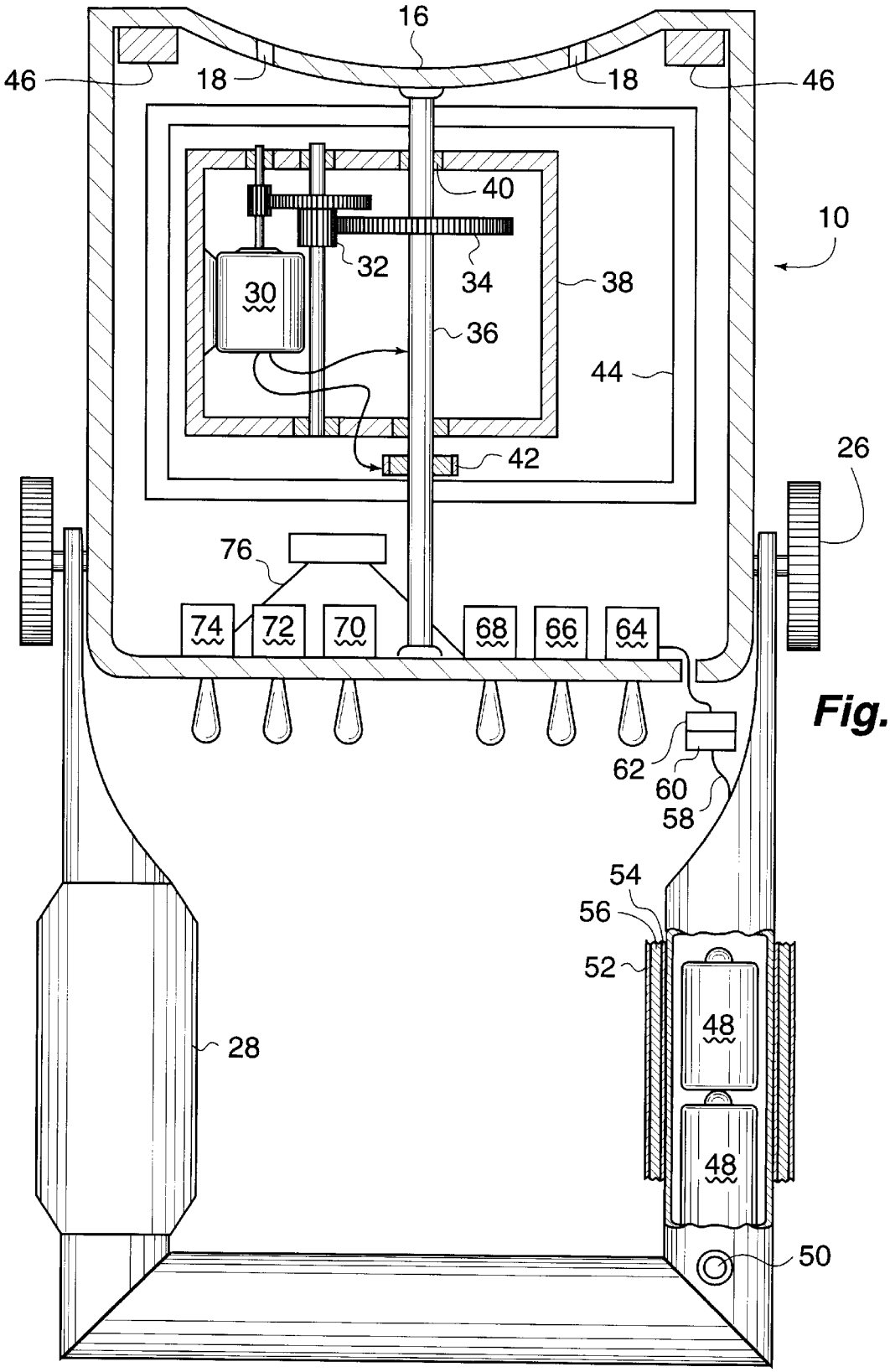
FIG. 3 is a sectional view illustrating the interior of the dumbbell.

FIG. 3 is a sectional view of the dumbbell and shows the details of the interior of the main tubular body 10 and the "U" shaped handle 12. The dumbbell generates strong vibrations from the rotation of the D.C. motor 30 which is geared down through gears 32 coupled to a large gear 34 attached to the stationary center shaft 36. The gears 32 and their shafts that rotate are on bearings in the housing 38 which surrounds the motor 30 and which rotates around the stationary center shaft 36. Thus, rotation of the motor 30 causes the housing 38, containing the motor 30 and gears 32, to rotate about the stationary shaft 36 causing a strong eccentric vibration of the body 10.

The stationary shaft 36 is rigidly attached in the body 10 between the centers of the concave end 16 and the opposite flat end 20 and have bearings 40 which permit rotation of the housing 38. The motor 30 is electrically energized through brushes coupled to the shaft 36 and to an electrically insulated ring 42 concentrically attached to the shaft 36, both of which are connected to a source of voltage.

The rotating housing 38 in the main body 10 should rotate about shaft 36 at a maximum speed of about 800 r.p.m. At that speed there may be considerable noise from the motor and the gears. Therefore, housing 38 should be insulated with a surrounding blanket of sound insulation 44 which may contact the interior walls of the main body 10 but must provide adequate space for rotation of the housing 38. Spaces between the insulation 44 and the interior top wall of body 10 is used for the installation of several colored diodes lamps 18 that flash when energized and a ring of permanent magnets or a solid magnetic ring 46 beneath the flat rim 14 around the concave end 16. As previously mentioned, the colored lamps 18 provide no function but merely add to the attraction of the dumbbell, and the magnetic ring 46 is for those who endorse the use of magnetic fields to improve blood circulation in body parts that may fit within the concave end 16 of the dumbbell.

In the space between the insulation 44 and the interior bottom end 20 of body 10 is adequate space for the several function switches, circuitry such as the pulse generator for electrode 22 and a speaker and associated audio circuitry.

The "U" shaped handle 12 is tubular with the interior of each side of the handle providing space for rechargeable batteries 48, which may be recharged as needed be connecting the plug of a battery charger into the jack 50 on the handle. The exterior surface of each side of handle 12, in locations where the user's hands grip the dumbbell, are covered with pressure sensitive switches 28. The two switches are identical, each is comprised of an electrically conductive outer layer 52 and an electrically conductive inner layer 54 with a soft spongy high resistance center 56 that is reduced in resistance as it is compressed. The outer layer 52 is preferably wrapped with a plastic coating to prevent salty perspiration from penetrating the resistance center 56. Thus, if there is no compression between layers 52 and 54, the resistance across the layers is an open circuit. As the compression is increased, the resistance across the layers is quickly decreased toward zero, thereby increasing the voltage to the motor 30 and increasing its rotational speed. Six conductors 58 extend from the handle 12 to a connector 60 for connecting the positive and negative battery terminals and the inner and outer conductive layers of each the two pressure sensitive switches 28 to the main body 10.

Figure 4:
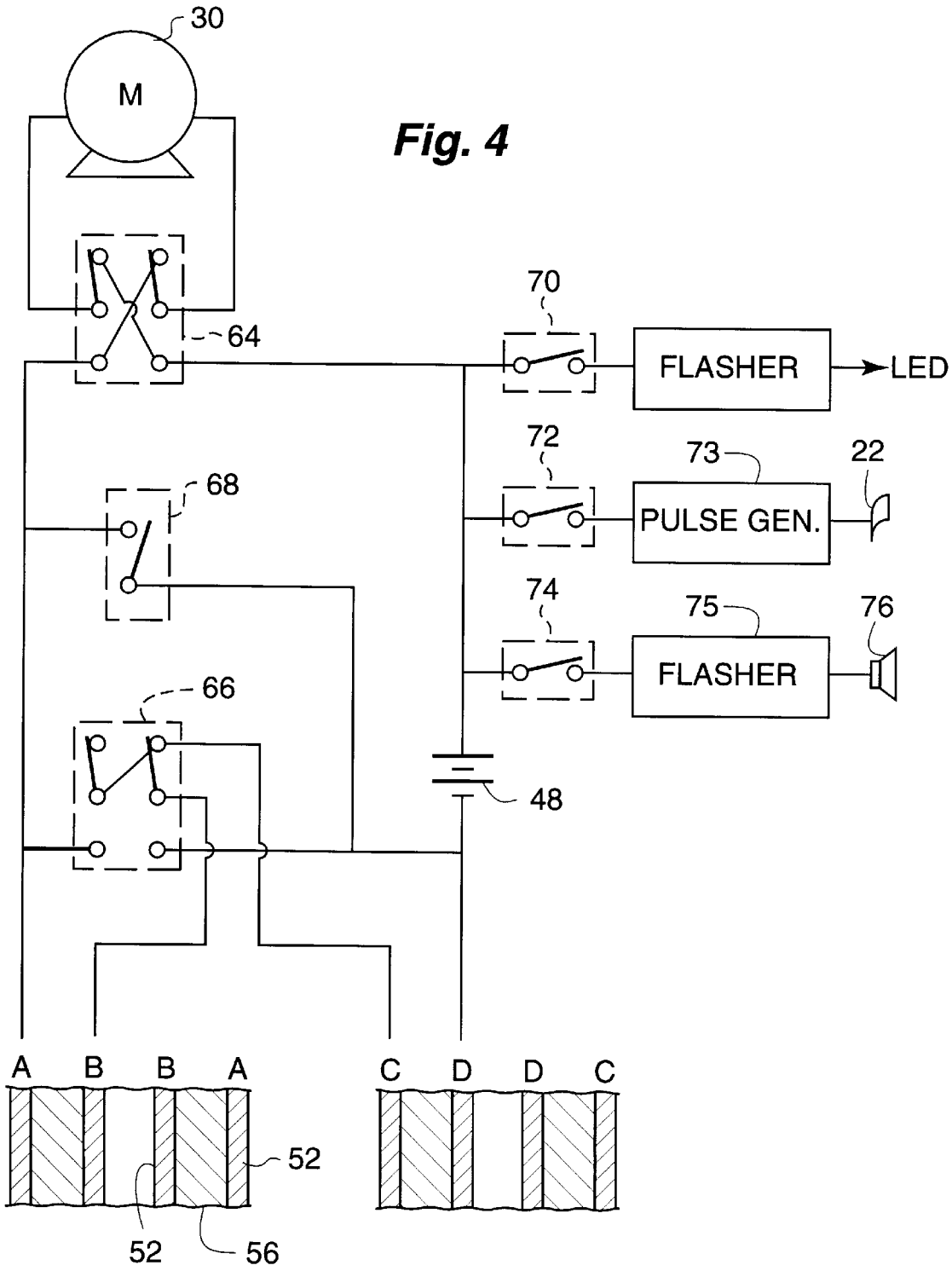
FIG. 4 is a circuit diagram of the electric circuitry of the dumbbell.

FIG. 4 is a diagram of the circuitry of the dumbbell. A multiconductor cable from the main body 10 is connected to the cable connector 62 which is coupled to the connector 60 from the batteries 48 and the two pressure sensitive switches 28 in the "U" shaped handle 12. The cable leads to the several function switches that are mounted in the flat end 20 of the body. These switches include a double-pole double throw switch 64 that reverses the motor voltage and hence its direction, a double-pole double-throw switch 66 which may be used to change the operation of the two pressure sensitive switches from series to parallel for one-hand operation or back to series for both-hand operation, a single-pole single-throw switch 68 for short circuiting both pressure sensitive switches for a hands-free operating mode, and three single-pole switches 70, 72, 74 for respectively selecting or extinguishing and flashing lights 18, a pulse generator 73 for conductive label 22, and a sound circuit 75 for a speaker 76, all of which may also be mounted on the flat end 20 of the body 10.

The off-axis motor in the dumbbell generates strong centrifugal vibrations that are transmitted to the joints and muscles through the body of the dumbbell and its handle. Merely gripping the handles will vibrate the hand muscles and joints of the hand. Using both hands to pull apart and press together the handles will transmit the vibrations to the arms and chest and switching the double-pole switch 66 will allow either a single hand or both hands to operate the unit, thereby strengthening underarm muscles. If the user is unable to apply sufficient pressure to activate a pressure activated switch, the switch 66 may be put into the "hands-free" position to short circuit both of the pressure activated switches.

Closing switch 72 will energize the pulse generator 73 to transmit a train of 60-volt, 200 microsecond pulses running at approximately 55- cycles per second to the conductive metallic label 22. Though not at a dangerous voltage level, the pulses should produce a slight muscle contraction for those standing on a conductive mat at circuit ground. And closing switch 74 will activate the sound circuit to produce prerecorded exercise music from speaker 76.

I claim:

1. An electronic exercising dumbbell comprising:

a tubular main body having first and second ends, said first end having a concave surface, said second end having substantially a flat surface and supporting a plurality of function switches;

a main shaft positioned on the axis of said tubular main body, said main shaft attached between said first and said second end;

a D.C. motor in said main body, said motor spaced from and rotatable around said main shaft, the rotation of said motor around said shaft generating strong vibrations of said dumbbell;

a handle having a "U" shape and being tubular for the storage of batteries for said D.C. motor, the end of each leg of the "U" being pivotally attached across said main body; and motor rotational speed controls on each leg of said "U" of said handle, said speed controls coupled between said batteries and said motor and activated by compression of said handle legs.

2. The electronic dumbbell claimed in claim 1 wherein said D.C. motor and said main shaft have gears for reducing the rotational speed of said motor around said shaft.

3. The electronic dumbbell claimed in claim 2 wherein said D.C. motor obtains its voltage through a first brush that wipes an insulated electrically conductive ring on said shaft for voltage of one polarity and a second brush that wipes said shaft for voltage of a second polarity.

4. The electronic dumbbell claimed in claim 3 further including a housing for said motor and said gears, said housing being rotatable with said motor and said gears around said shaft.

5. The electronic dumbbell claimed in claim 4 further including a blanket of sound insulation within said main body, said blanket being clear of the rotation of said housing.

6. The electronic dumbbell claimed in claim 1 wherein said motor speed controls on each leg of each "U" of said handle is an electrical resistance element that varies from infinite resistance with no compression to zero resistance with maximum compression.

7. The electronic dumbbell claimed in claim 6 wherein each of said motor speed controls on each leg are coupled into said main body and are normally connected in series for two-hand operation by said function switches.

8. The electronic dumbbell claimed in claim 7 wherein a switching of a first one of said function switches changes the operation of said motor speed controls from series to parallel for one-hand operation.

9. The electronic dumbbell claimed in claim 8 wherein a closure of a second one of said function switches shorts out both of said speed controls on both legs for operation in a hands-free mode.

10. The electronic dumbbell claimed in claim 1 further including a small sound amplifier and speaker in said main body, said sound amplifier being energized by the closure of a function switch connected to said batteries.

11. The electronic dumbbell claimed in claim 1 further including a pulse generator coupled to an insulated electrically conductive electrode on the exterior surface of said body, said pulse generator producing a train of very narrow pulses of a non-damaging voltage upon the closure of a function switch connected to said batteries.

12. The electronic dumbbell claimed in claim 1 further including a plurality of light emitting diodes scattered on a surface of said main body and emitting flashes of colored light upon closure of a function switch connected to said batteries.

13. The electronic dumbbell claimed in claim 1 further including a permanent magnetic ring in said main body and surrounding the concave surface of said first end of said body.

* * * * *